US006047550A

United States Patent [19]

Beebe

[11] Patent Number: 6,047,550

[45] **Date of Patent: *Apr. 11, 2000**

[54] PREMIXING DRY LOW NOX EMISSIONS COMBUSTOR WITH LEAN DIRECT INJECTION OF GAS FUEL

[75] Inventor: Kenneth W. Beebe, Galway, N.Y.

[73] Assignee: General Electric Co., Schenectady, N.Y.

[ * ] Notice: Under 35 U.S.C. 154(b), the term of this patent shall be extended for 764 days.

[21] Appl. No.: 08/643,048

[22] Filed: May 2, 1996

[51] Int. Cl.[7] ..... F02C 1/00

[52] U.S. Cl. ..... 60/737; 60/747; 60/749; 60/733

[58] Field of Search ..... 60/737, 738, 739, 60/740, 746, 747, 748, 749, 733

[56] References Cited

U.S. PATENT DOCUMENTS

| | | | |
|---|---|---|---|
| 2,944,388 | 7/1960 | Bayer | 60/261 |
| 3,934,409 | 1/1976 | Quillevere | 60/733 |
| 4,052,844 | 10/1977 | Caruel et al. | 60/733 |
| 4,058,977 | 11/1977 | Markowski et al. | 60/39.65 |
| 4,292,801 | 10/1981 | Wilkes et al. . | |
| 4,671,069 | 6/1987 | Sato et al. . | |
| 4,731,989 | 3/1988 | Furuya et al. . | |
| 4,898,001 | 2/1990 | Kuroda et al. . | |
| 4,910,957 | 3/1990 | Moreno et al. . | |
| 4,928,481 | 5/1990 | Joshi et al. . | |
| 4,955,191 | 9/1990 | Okamoto et al. . | |
| 5,069,029 | 12/1991 | Kuroda et al. . | |
| 5,297,391 | 3/1994 | Roche | 60/261 |
| 5,385,015 | 1/1995 | Clements et al. | 60/261 |
| 5,394,688 | 3/1995 | Amos | 60/747 |
| 5,479,781 | 1/1996 | Fric et al. | 60/740 |

OTHER PUBLICATIONS

Lean Primary Zones: Pressure Loss and Residence Time Influences on Combustion Performance and NOx Emissions, M.M. Abdul Aziz et al., Department of Fuel and Energy, University of Leeds, Leeds, United Kingdom, 1987 Tokyo International Gas Turbine Congress, pp. 89–96.

*Primary Examiner*—Timothy S. Thorpe
*Assistant Examiner*—Cheryl J. Tyler
*Attorney, Agent, or Firm*—Nixon & Vanderhye

[57] ABSTRACT

Lean premixed combustion of a hydrocarbon fuel and air is combined with lean direct injection of hydrocarbon fuel and air into a combustor downstream of the premixed reaction zone in order to achieve extremely low levels of emissions of oxides of nitrogen at the high combustor exit temperatures required by advanced heavy duty industrial gas turbines. One or more premixing fuel nozzles are used to supply a lean mixture of hydrocarbon fuel and air to the main or primary reaction zone of a gas turbine combustor. This lean fuel/air mixture has an adiabatic flame temperature below the temperature that would result in substantial thermal NOx formation. After this low temperature reaction has been completed, additional fuel and air are injected into the products of combustion downstream of the main reaction zone in order to raise the temperature of the mixture to the level required to operate an advanced, high efficiency, heavy duty industrial gas turbine at high load. Formation of nitrogen oxides in the region after this secondary fuel and air injection is minimized by partial premixing of fuel and air prior to ignition and by minimizing the residence time between the secondary fuel injection and the turbine first stage inlet.

13 Claims, 2 Drawing Sheets

PREMIXING DRY LOW NOX EMISSIONS COMBUSTOR WITH LEAN DIRECT INJECTION OF GAS FUEL

TECHNICAL FIELD

This invention relates to gas and liquid fuel turbines and, more specifically, to combustors in industrial gas turbines use d in power gene ration plants.

BACKGROUND

Gas turbine manufacturers, including General Electric, are currently involved in research and engineering programs to produce new gas turbines that will operate at high efficiency without producing undesirable air polluting emissions. The primary air polluting emissions usually produced by gas turbines burning conventional hydrocarbon fuels are oxides of nitrogen, carbon monoxide and unburned hydrocarbons. It is well known in the art that oxidation of molecular nitrogen in air breathing engines is highly dependent upon the maximum hot gas temperature in the combustion system reaction zone and the residence time for the reactants at the highest temperatures reached within the combustor. The level of thermal NOx formation is minimized by maintaining the reaction zone temperature below the level at which thermal NOx is formed or by maintaining an extremely short residence time at high temperature such that there is insufficient time for the NOx formation reactions to progress.

One preferred method of controlling the temperature of the reaction zone of a heat engine combustor below the level at which thermal NOx is formed is to premix fuel and air to a lean mixture prior to combustion. U.S. Pat. No. 4,292,801 dated October 1981, the disclosure of which is hereby incorporated by reference, describes a dual stage-dual mode low NOx combustor for gas turbine application which is one of the pioneering combustor designs based on lean premixed combustion technology. U.S. Pat. No. 5,259,184 dated November 1993, the disclosure of which is also hereby incorporated by reference, describes a dry low NOx single stage dual mode combustor construction for a gas turbine. The thermal mass of the excess air present in the reaction zone of a lean premixed combustor absorbs heat and reduces the temperature rise of the products of combustion to a level where thermal NOx is not formed. Even with this technology, for the most advanced high efficiency heavy duty industrial gas turbines, the required temperature of the products of combustion at the combustor exit/first stage turbine inlet at maximum load is so high that the combustor must be operated with peak gas temperature in the reaction zone which exceeds the thermal NOx formation threshold temperature resulting in significant NOx formation even though the fuel and air are premixed lean. The problem to be solved is to obtain combustor exit temperatures high enough to operate the most advanced, high efficiency heavy duty industrial gas turbines at maximum load without forming a significant amount of thermal NOx.

Lean premixed combustion of hydrocarbon fuels in air is widely used throughout the gas turbine industry as a method of reducing air pollutant levels, in particular thermal NOx emissions levels, for gas turbine combustors. Lean direct injection (LDI) of hydrocarbon fuel and air has also been shown to be an effective method for reducing NOx emission levels for gas turbine combustion systems although not as effective as lean premixed combustion. An example of an LDI fuel injector assembly is described in an article from the 1987 Tokyo International Gas Turbine Congress entitled "Lean Primary Zones: Pressure Loss and Residence Time Influences on Combustion Performance and NOx Emissions," the disclosure of which is hereby incorporated by reference. The present invention combines these two technologies; i.e., lean premixed combustion and lean direct fuel injection, in a novel and unique manner in order to achieve extremely low air pollutant emissions levels, particularly oxides of nitrogen, when operating an advanced, high efficiency, heavy duty industrial gas turbine at high load.

DISCLOSURE OF THE INVENTION

An object of this invention is to combine premixed combustion of a lean mixture of hydrocarbon fuel and air with lean direct injection of hydrocarbon fuel and air into the products of lean premixed combustion late in the combustion process, and thereby produce a combustion system that will yield very low emissions of air pollutants, in particular oxides of nitrogen, when operating an advanced, high efficiency, heavy duty industrial gas turbine at high load. Moreover, this invention is intended to accomplish this objective while operating the premixed combustion reaction zone with a fuel/air mixture that is lean enough to ensure that the thermal NOx formation in the reaction zone is negligible and while operating the entire combustion system at an overall fuel/air mixture strength that exceeds that of the premixed reaction zone by the amount necessary to meet the inlet temperature demands of the gas turbine. This invention is particularly advantageous in applications where the inlet temperature demands of the turbines are so high as to preclude the possibility of achieving very low thermal NOx emissions levels by lean premixed combustion alone.

These and other objects are achieved by providing a combustor for a gas turbine including a primary combustion system operable in a plurality of gas turbine modes, the gas turbine modes being determined based on a load range on the gas turbine, and a secondary combustion system selectively operable in a high load range mode of the plurality of gas turbine modes.

The combustor may further be provided with a combustor casing having an open end and an end cover assembly secured to another end thereof, a flow sleeve mounted within the casing, and a combustion liner within the flow sleeve and defining at least a primary reaction zone. The primary combustion system preferably includes a sleeve cap assembly secured to the casing and located axially downstream of the end cover assembly, and at least one start up fuel nozzle and premixing fuel nozzles communicating with the primary reaction zone. In this regard, each premixing fuel nozzle preferably includes a swirler including a plurality of swirl vanes that impart rotation to entering air, and a plurality of fuel spokes that distribute fuel in the rotating air stream. The combustion liner may also define a secondary reaction zone downstream of the primary reaction zone. In this context, the secondary combustion system includes a lean direct injection (LDI) fuel injector assembly communicating with the secondary reaction zone. The LDI fuel injector assembly preferably includes an air manifold, a fuel manifold, and a plurality of fuel/air injection spokes communicating with the air manifold and the fuel manifold. The plurality of fuel/air injection spokes penetrate the combustion liner and introduce fuel and air into the secondary reaction zone.

In accordance with another aspect of the invention, there is provided a gas turbine including a compressor section that pressurizes inlet air, a combustion section disposed downstream of the compressor section that receives the pressurized inlet air, and a turbine section disposed downstream of the combustion section and receiving hot products of combustion from the combustion section. The combustion section includes a circular array of circumferentially spaced combustors according to the invention.

In accordance with still another aspect of the invention, there is provided a method of combustion in a gas turbine combustor according to the invention. The method includes the steps of (a) in a low range turbine load mode, supplying fuel to start up fuel nozzles and mixing the fuel with air in a primary reaction zone, (b) in a mid-range turbine load mode, supplying fuel to premixing fuel nozzles and premixing the fuel with air prior to entering the primary reaction zone, and (c) in a high-range turbine load mode, carrying out step (b) and then supplying secondary fuel and air to a secondary combustion system and introducing fuel and air into a secondary reaction zone.

BRIEF DESCRIPTION OF THE DRAWINGS

These and other aspects and advantages of the present invention will become clear in the following description of the invention with reference to the accompanying drawings in which.

BEST MODE FOR CARRYING OUT THE INVENTION

Reference will now be made in detail to the present preferred embodiments of the invention, an example of which is illustrated in the accompanying drawings.

As is well known, a gas turbine includes a compressor section, a combustion section and a turbine section. The compressor section is driven by the turbine section through a common shaft connection. The combustion section typically includes a circular array of a plurality of circumferentially spaced combustors. A fuel/air mixture is burned in each combustor to produce the hot energetic flow of gas, which flows through a transition piece for flowing the gas to the turbine blades of the turbine section. A conventional combustor is described in the above-noted U.S. Pat. No. 5,259,184. For purposes of the present description, only one combustor is illustrated, it being appreciated that all of the other combustors arranged about the turbine are substantially identical to the illustrated combustor.

Figure 1:
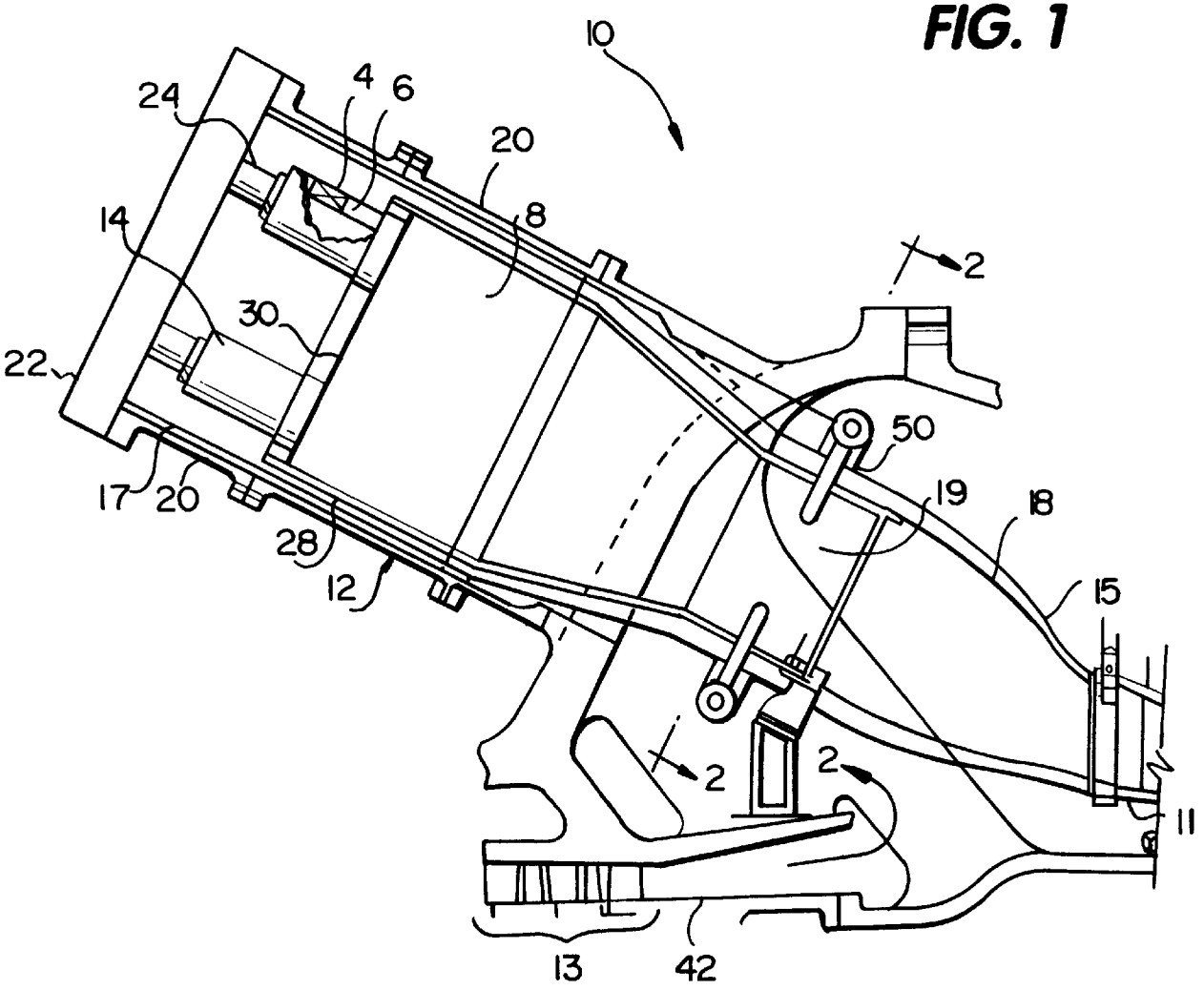
FIG. 1 is a schematic cross-sectional illustration of a lean premixed combustor forming part of a gas turbine and constructed in accordance with the present invention.

Referring now to FIG. 1, there is shown generally at 10, a combustor for a gas turbine engine including a lean premixed combustion assembly 12, a secondary or lean direct injection (LDI) fuel injector assembly 50, and a transition piece 18 for flowing hot gases of combustion to the turbine nozzles 11 and the turbine blades (not shown). The lean premixed combustor assembly 12 includes a casing 20, an end cover 22, a plurality of start-up fuel nozzles 24, a plurality of premixing fuel nozzles 14, a cap assembly 30, a flow sleeve 17, and a combustion liner 28 within the sleeve 17. A suitable cap assembly is described in U.S. Pat. No. 5,274,991, the disclosure of which is hereby incorporated by reference. An ignition device (not shown) is provided and preferably comprises an electrically energized spark plug. Combustion in the lean premixed combustor assembly 12 occurs within the combustion liner 28. Combustion air is directed within the liner 28 via the flow sleeve 17 and enters the combustion liner through a plurality of openings formed in the cap assembly 30. The air enters the liner under a pressure differential across the cap assembly 30 and mixes with fuel from the start-up fuel nozzles 24 and/or the premixing fuel nozzles 14 within the liner 28. Consequently, a combustion reaction occurs within the liner 28 releasing heat for the purpose of driving the gas turbine. High pressure air for the lean premixed combustor assembly 12 enters the flow sleeve 17 and a transition piece impingement sleeve 15, from an annular plenum 2. This high pressure air is supplied by a compressor, which is represented by a series of vanes and blades at 13 and a diffuser 42.

Each premixing fuel nozzle 14 includes a swirler 4, consisting of a plurality of swirl vanes that impart rotation to the entering air and a plurality of fuel spokes 6 that distribute fuel in the rotating air stream. The fuel and air then mix in an annular passage within the premix fuel nozzle 14 before reacting within the primary reaction zone 8.

Figure 3:
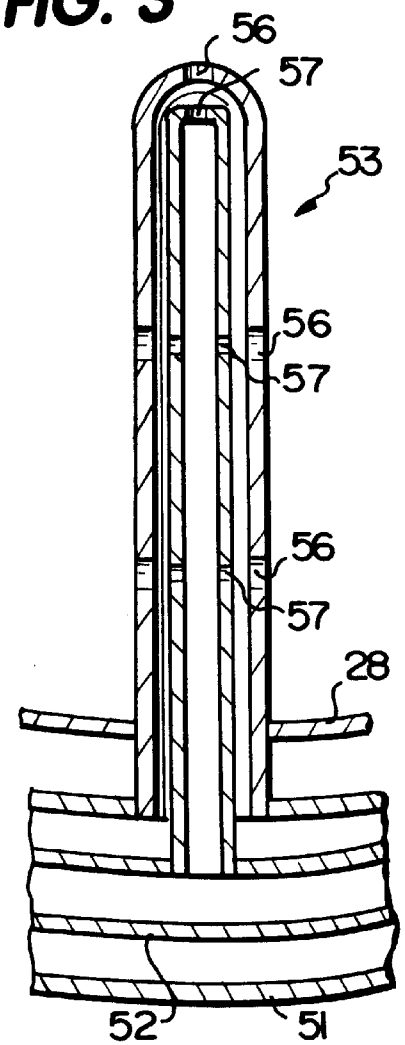
FIG. 3 is a cross-sectional illustration of one fuel/air injection spoke taken from FIG. 2.
Figure 2:
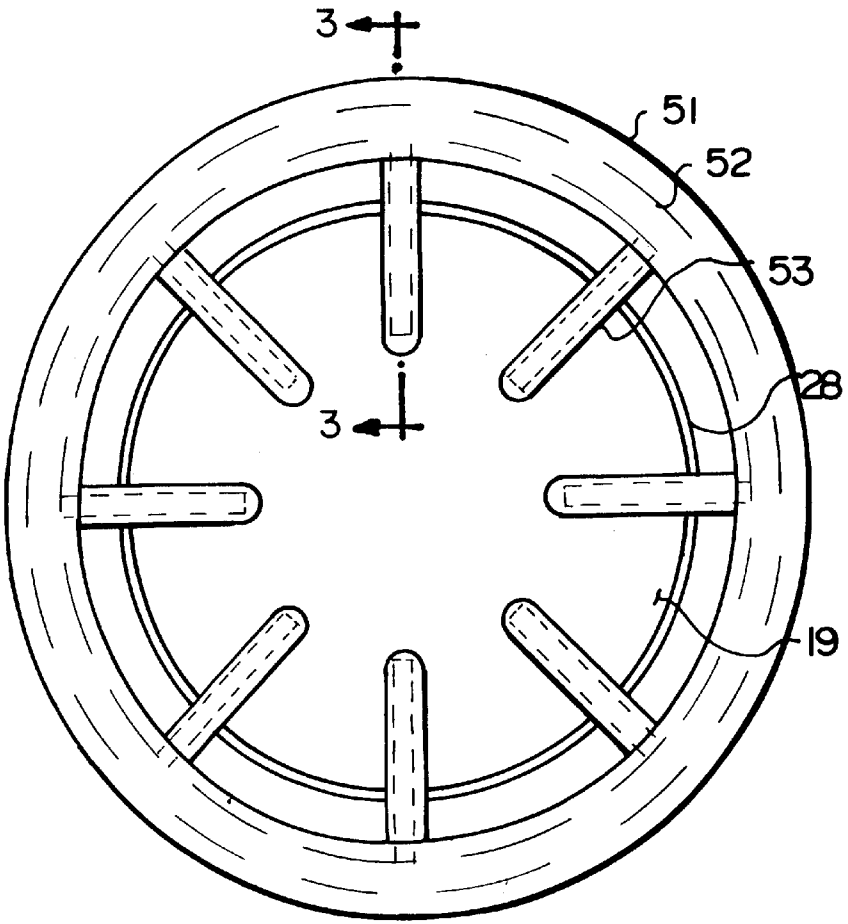
FIG. 2 is a cross-sectional view thereof taken generally along line 2—2 in FIG. 1.

The LDI fuel injector assembly 50 is provided for operating at gas turbine high load conditions. Referring to FIGS. 2 and 3, the assembly 50 includes an air manifold 51, a fuel manifold 52, and a plurality of fuel/air injection spokes 53 that penetrate the combustion liner 28 and introduce additional fuel and air into the secondary reaction zone 19 within the combustor assembly. This secondary fuel/air mixture is ignited by the hot products of combustion exiting the primary reaction zone 8, and the resulting secondary hydrocarbon fuel oxidation reactions go to completion in the transition piece 18. The secondary fuel is injected into the secondary air via a plurality of fuel orifices 57, and the combination of secondary fuel and secondary air is injected into the secondary reaction zone 19 via a plurality of air orifices 56 in each fuel/air injection spoke 53.

In operation of the gas turbine, there are three distinct operating modes depending upon the load range on the gas turbine. The first operating mode is at low turbine load (about 0–30% of base load) and during initial start up. In this mode, hydrocarbon fuel is supplied to the start-up fuel nozzles 24, and combustion air is provided to the liner 28 through the plurality of openings in the cap assembly 30 for mixing with the fuel from the start-up fuel nozzles 24. A diffusion flame reaction occurs within the combustion liner 28 at the primary reaction zone 8. This reaction is initiated by an electrically energized spark plug.

At mid-range operating conditions (about 30–80% of base load), hydrocarbon fuel is supplied to the premixing fuel nozzles 14 via the fuel spokes 6. The premixer 14 mixes the hydrocarbon fuel with air from the swirler 4, and the mixture enters the primary reaction zone 8. The mixture of fuel and air ignites in the presence of the diffusion flame from the start-up fuel nozzles 14. Once the premixed combustion reaction has been initiated, hydrocarbon fuel is diverted from the start-up fuel nozzles 24 to the premixing fuel nozzles 14. The diffusion flame in the primary reaction zone 8 then goes to extinction, and the combustion reaction in the primary reaction zone 8 becomes entirely premixed. Because the fuel/air mixture entering the primary reaction zone 8 is lean, the combustion reaction temperature is too low to produce a significant amount of thermal NOx. The hydrocarbon fuel oxidation reactions go to completion in the primary reaction zone 8 within the combustion liner 28. Thus, during mid-range load conditions, the temperature of the combustion reaction is too low to produce a significant amount of thermal NOx.

Under high load conditions (about 80% of base load to peak load), premixed combustion is carried out as described above. Additionally, hydrocarbon fuel and air are supplied to the LDI fuel injector assembly 50. The assembly 50 introduces secondary fuel and air into the secondary reaction zone 19 where auto-ignition occurs due to the high temperatures existing within the combustion liner 28 at mid-load and high load conditions. The secondary hydrocarbon fuel oxidation reactions go to completion in the transition piece 18. Because the secondary fuel/air mixture entering the transition piece 18 is lean, the combustion reaction temperature is lower than the stoichiometric flame temperature, and the thermal NOx formation rate is low. Since the residence time in the transition piece 18 is short and the thermal NOx formation rate is low, very little thermal NOx is formed during secondary fuel combustion.

Consequently, it will be appreciated that NOx emissions are substantially minimized or eliminated through the mid-load and high load operating ranges of high firing temperature, high efficiency heavy duty industrial gas turbines. This has been accomplished simply and efficiently and by a unique cooperation of essentially known gas turbine elements. Both lean premixed combustion, used as the primary combustion system for this invention, and lean direct fuel injection, used as the secondary combustion system for this invention, are well known NOx abatement methods in the gas turbine industry. This invention is a novel and unique combination of these methods to achieve extremely low NOx emission levels for state of the art, high efficiency, heavy duty industrial gas turbines.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed:

1. A combustor for a gas turbine comprising:

a primary combustion system for combusting a mixture of gaseous fuel and air, and operable in a plurality of gas turbine modes, said gas turbine modes being determined based on a load range of the gas turbine; and a secondary combustion system selectively operable in a high load range mode of the plurality of gas turbine modes, wherein said secondary combustion system comprises a lean direct injection (LDI) fuel injector assembly, said LDI fuel injector assembly comprising an air manifold, a gas fuel manifold, and a plurality of gas fuel/air injection spokes communicating with said air manifold and said gas fuel manifold.

2. A combustor according to claim 1, further comprising:

a combustor casing having an open end and an end cover assembly secured to another end thereof;

a flow sleeve mounted within said casing; and a combustion liner within said flow sleeve and defining at least a primary reaction zone;

wherein said primary combustion system comprises a sleeve cap assembly secured to said casing and located axially downstream of said end cover assembly, and at least one start-up fuel nozzle and a plurality of premixing fuel nozzles communicating with said primary reaction zone.

3. A combustor according to claim 2, wherein each premixing fuel nozzle comprises:

a swirler including a plurality of swirl vanes that impart rotation to entering air; and a plurality of fuel spokes that distribute fuel in the rotating air stream.

4. A combustor according to claim 3, wherein said combustion liner defines a secondary reaction zone downstream of said primary reaction zone, said secondary combustion system comprising a lean direct injection (LDI) fuel injector assembly communicating with said secondary reaction zone.

5. A combustor according to claim 4, wherein said LDI fuel injector assembly comprises an air manifold, a fuel manifold, and a plurality of fuel/air injection spokes communicating with said air manifold and said fuel manifold, said plurality of fuel/air injection spokes penetrating the combustion liner for introducing fuel and air into said secondary reaction zone.

6. A combustor according to claim 1, further comprising a transition piece disposed downstream of said primary combustion system and said secondary combustion system for flowing hot gases of combustion to turbine nozzles of the gas turbine.

7. A gas turbine comprising:

a compressor section for pressurizing inlet air;

a combustion section disposed downstream of the compressor section for receiving the pressurized inlet air; and a turbine section disposed downstream of the combustion section for receiving hot products of combustion from the combustion section, wherein the combustion section comprises:

a primary combustion system operable in a plurality of gas turbine modes, said gas turbine modes being determined based on a load range of the gas turbine, and a secondary combustion system selectively operable in a high load range mode of the plurality of gas turbine modes, wherein said secondary combustion system comprises a lean direct injection (LDI) fuel injector assembly, said LDI fuel injector assembly comprising an air manifold, a fuel manifold, and a plurality of fuel/air injection spokes communicating with said fuel manifold.

8. A gas turbine according to claim 7, wherein said combustion section further comprises:

a combustor casing having an open end and an end cover assembly secured to another end thereof;

a flow sleeve mounted within said casing; and a combustion liner within said flow sleeve and defining at least a primary reaction zone;

wherein said primary combustion system comprises a sleeve cap assembly secured to said casing and located axially downstream of said end cover assembly, and at least one start-up fuel nozzle and a plurality of premixing fuel nozzles communicating with said primary reaction zone.

9. A gas turbine according to claim 8, wherein each premixing fuel nozzle comprises:

a swirler including a plurality of swirl vanes that impart rotation to entering air; and a plurality of fuel spokes that distribute fuel in the rotating air stream.

10. A gas turbine according to claim 8, wherein said combustion liner defines a secondary reaction zone downstream of said primary reaction zone, said secondary combustion system comprising a lean direct injection (LDI) fuel injector assembly communicating with said secondary reaction zone.

11. A gas turbine according to claim 10, wherein said LDI fuel injector assembly comprises an air manifold, a fuel manifold, and a plurality of fuel/air injection spokes communicating with said air manifold and said fuel manifold, said plurality of fuel/air injection spokes penetrating the combustion liner for introducing fuel and air into said secondary reaction zone.

12. A gas turbine according to claim 7, wherein said combustion system further comprises a transition piece disposed downstream of said primary combustion system and said secondary combustion system for flowing hot gases of combustion to the turbine section.

13. A combustor for a gas turbine, the combustor having a reaction zone and comprising:

a primary combustion system for combusting a mixture of fuel and air, and operable in a plurality of gas turbine modes, said gas turbine modes being determined based on a load range of the gas turbine; and a secondary combustion system selectively operable in a high load range mode of the plurality of gas turbine modes, wherein said secondary combustion system comprises a lean direct injection (LDI) fuel injector assembly, said LDI fuel injector assembly including structure that separately supplies fuel and air to the reaction zone.

* * * * *

UNITED STATES PATENT AND TRADEMARK OFFICE

CERTIFICATE OF CORRECTION

PATENT NO. : 6,047,550
DATED : April 11, 2000
INVENTOR(S) : Beebe

It is certified that error appears in the above-identified patent and that said Letters Patent is hereby corrected as shown below:

Title page,
[*] delete "764" and insert -- 109 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*